US005310156A

United States Patent [19]

Matsumura et al.

[11] Patent Number: 5,310,156

[45] Date of Patent: May 10, 1994

[54] EARTHQUAKE-PROOF LEG SUPPORT STRUCTURE OF ELECTRONIC APPARATUS

[75] Inventors: Tadanobu Matsumura; Yasuhide Iwamoto; Yoshio Makino; Osamu Nishina; Katuei Satou; Takasi Watanabe; Yujiro Hata; Toshiro Kubo; Wataru Ishizu; Takashi Simura, all of Kawasaki, Japan

[73] Assignee: Fujitsu Limited, Kawasaki, Japan

[21] Appl. No.: 933,703

[22] Filed: Aug. 24, 1992

[30] Foreign Application Priority Data

Oct. 3, 1991 [JP] Japan ..... 3-256775
Feb. 19, 1992 [JP] Japan ..... 4-031237

[51] Int. Cl.[5] ..... F16M 13/00

[52] U.S. Cl. ..... 248/615; 52/167 R; 248/188.9; 248/638

[58] Field of Search ..... 248/638, 188.9, 634, 248/615, 616, 636; 188/267; 52/167 R, 167 DF

[56] References Cited

U.S. PATENT DOCUMENTS

| | | | |
|---|---|---|---|
| 2,660,387 | 11/1953 | Roy | 248/615 X |
| 3,332,647 | 7/1967 | Young | 248/615 X |
| 3,730,463 | 5/1973 | Richard | 52/167 R X |
| 3,815,852 | 6/1974 | May | 248/615 X |
| 4,368,864 | 1/1983 | Tobey | 248/188.9 |
| 4,517,778 | 5/1985 | Nicolai | 52/167 |
| 4,575,034 | 3/1986 | Tobey | 248/188.9 |
| 4,576,357 | 3/1986 | Schrepfer | 248/615 X |
| 4,726,161 | 2/1988 | Yaghoubian | 52/167 |
| 4,752,056 | 6/1988 | Culbertson | 248/188.9 |
| 4,883,250 | 11/1989 | Yano et al. | 248/638 |
| 4,965,895 | 10/1990 | Shustov | 5/414 |
| 4,974,378 | 12/1990 | Shustov | 52/167 R |
| 5,181,356 | 1/1993 | Sul | 52/167 DF |

FOREIGN PATENT DOCUMENTS

| | | | |
|---|---|---|---|
| 953483 | 11/1956 | Fed. Rep. of Germany | 248/615 |
| 1074332 | 1/1960 | Fed. Rep. of Germany | 248/615 |
| 0000647 | 1/1983 | Japan | 248/615 |
| 3-93292 | 4/1991 | Japan . | |

*Primary Examiner*—J. Franklin Foss
*Attorney, Agent, or Firm*—Staas & Halsey

[57] ABSTRACT

An earthquake-proof leg support structure (10) of an electronic apparatus comprising a leg (12) vertically downwardly extending from the outer case (1) and a dish-shaped leg support seat (20) to receive the leg (12). The leg support seat (20) includes a metal element (28) having an upper surface (22) over which the leg (12) slides and a peripheral flange (24) against which the leg (12) abuts, and a plastic liner (30) having a lower flat smooth surface (26) which is slidable on the floor. The lower end surface (14) of the leg is of a convex spherical shape and the upper surface (22) of the leg support seat includes a central surface portion (**22*a*) of a concave spherical shape and a cone-shaped slope portion (22*b*) arranged around and tangential to the central surface portion, with the radius of curvature of the leg (12) being smaller than that of the upper surface (22) of the leg support seat (20**).

16 Claims, 10 Drawing Sheets

EARTHQUAKE-PROOF LEG SUPPORT STRUCTURE OF ELECTRONIC APPARATUS

BACKGROUND OF THE INVENTION

1. Field of the Invention

The present invention relates to an earthquake-proof leg support structure of an electronic apparatus, such as a computer, placed on a floor and, in particular, relates to a leg support structure in which a plurality of legs downwardly extending from an outer case of an electronic apparatus are slidably supported by leg supporting seats.

2. Description of the Related Art

Electronic apparatuses usually have an outer case in which electronic elements and printed wiring boards are installed. The outer case is supported on a floor by downwardly extending legs. Recently, it has been requested that the legs of electronic apparatuses be made earthquake-proof in structure so the electronic apparatuses are less affected by vibration during an earthquake. However, problems exist in the conventional earthquake-proof leg support structures such as the space for placing the electronic apparatus, the cost of the earthquake-proof leg support structure, and the difficulty of assembly. Under these circumstances, it has been requested to provide a compact and easily assembled leg support structure of an electronic apparatus by which an earthquake-proof action is reliably established.

Japanese Unexamined Patent Publication (Kokai) No. 3-93292 discloses an earthquake-proof leg support structure of an electronic apparatus in which a plurality of legs extend vertically downward from an outer case of the electronic apparatus and dish-shaped leg support seats are arranged under the legs. Each leg support seat has an upper flat smooth surface with which the lower end of the leg slidably engages and a peripheral flange surrounding the upper flat smooth surface. Each leg support seat also includes a damper plate and a friction plate, the friction plate being put on the floor. In the case of an earthquake, the leg support seat follows the floor but the leg of the electronic apparatus is slidable relative to the leg support seat and remains substantially at the original position due to inertia, so the leg displaces relative to the floor to thereby give an earthquake-proof effect.

However, in the conventional earthquake-proof leg support structure, if the amplitude of oscillatory movement of the earthquake is relatively small the leg moves along the upper flat smooth surface of the leg support seat within the range of the upper flat smooth surface, but if the leg is initially not exactly positioned at the center of the upper flat smooth surface of the leg support seat or if the amplitude of oscillatory movement of the earthquake is relatively large so that the leg support seat moves beyond the extent of the radius thereof, the leg may impinge against the peripheral flange of the leg support seat, creating an impact. Also, a frictional force between the leg support seat and the floor prevents the leg from further horizontally moving relative to the leg support seat, generating a moment rotating the electronic apparatus, and there is a possibility of the electronic apparatus falling over.

SUMMARY OF THE INVENTION

The object of the present invention is to solve the above described problems and to provide a leg support structure of an electronic apparatus by which the electronic apparatus can be supported with less influence of vibration of an earthquake or the like and without falling over even in the case of a large earthquake.

According to the present invention, there is provided a leg support structure of an electronic apparatus having an outer case, the leg support structure comprising legs extending vertically downward from the outer case and having lower end surfaces shaped in a convex spherical shape and dish-shaped leg support seats having upper surfaces for slidably receiving the lower end surfaces of the legs and including central surface portions shaped in a concave spherical shape and a periphery, peripheral flanges upwardly rising on the periphery of the upper surfaces, and lower flat smooth surfaces adapted to be put on a supporting surface.

With this arrangement, in the case of an earthquake in which the floor is subjected to vibration, the moving leg support seats slide relative to the legs of the electronic apparatus, so that the electronic apparatus is less affected by the vibration. By the provision of the central surface portions shaped in a concave spherical shape in the upper surfaces of the leg support seats, the legs supporting the weight of the electronic apparatus cause the leg support seats to return to their original positions at the end of the earthquake, and thus the legs are normally placed at the center of the leg support seats.

Also, since the leg support seats have the lower flat smooth surfaces adapted to be put on the supporting surface, i.e., the floor, when the amplitude of vibration of the earthquake is relatively large, the leg support seats first slide relative to the legs of the electronic apparatus until the legs abut against the edge of the leg support seats, i.e., the peripheral flanges of the leg support seats, and then the leg support seats slide with the legs relative to the floor, so that the electronic apparatus is prevented from falling over.

Preferably, the lower end surfaces of the legs have a first radius of curvature, and the central surface portions of the upper surfaces of the leg support seats have a second radius of curvature, the first radius of curvature being smaller than the second. Accordingly, the legs make substantially point contact with the leg support seats, so that the frictional resistance therebetween is constant over the leg support seats and the legs slide smoothly along the leg support seats.

Preferably, the upper surfaces of the leg support seats have cone shaped slope portions arranged around and tangential to the central surface portions. In this case, the cone-shaped slope portions are preferably arranged at an angle of approximately one degree with a plane parallel to the lower flat smooth surfaces of the leg support seats.

Preferably, the leg support seats comprise dish-shaped metal elements formed with upper surfaces and peripheral flanges. Liners are fixedly attached to the dish-shaped metal elements and form lower flat smooth surfaces. The liners have a good sliding property. In this case, the dish-shaped metal elements preferably have bottom surfaces, outer peripheral lobes arranged adjacent to the bottom surfaces and protruding from the peripheral flanges, outer peripheral surfaces about the outer peripheral lobes, a first dimension measured along a predetermined line across the outer peripheral surface between two intersections of the predetermined line and the outer peripheral surface, inner peripheral surfaces in the peripheral flanges, and a second dimension measured along the predetermined line across the inner peripheral surface between two intersections of the predetermined line and the outer peripheral surface. The liners have an outer peripheral surface and a third dimension measured along the predetermined line across the outer peripheral surface thereof between two intersections of the predetermined line and the outer peripheral surface, the third dimension being smaller than the first dimension and greater than the second dimension.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 4:
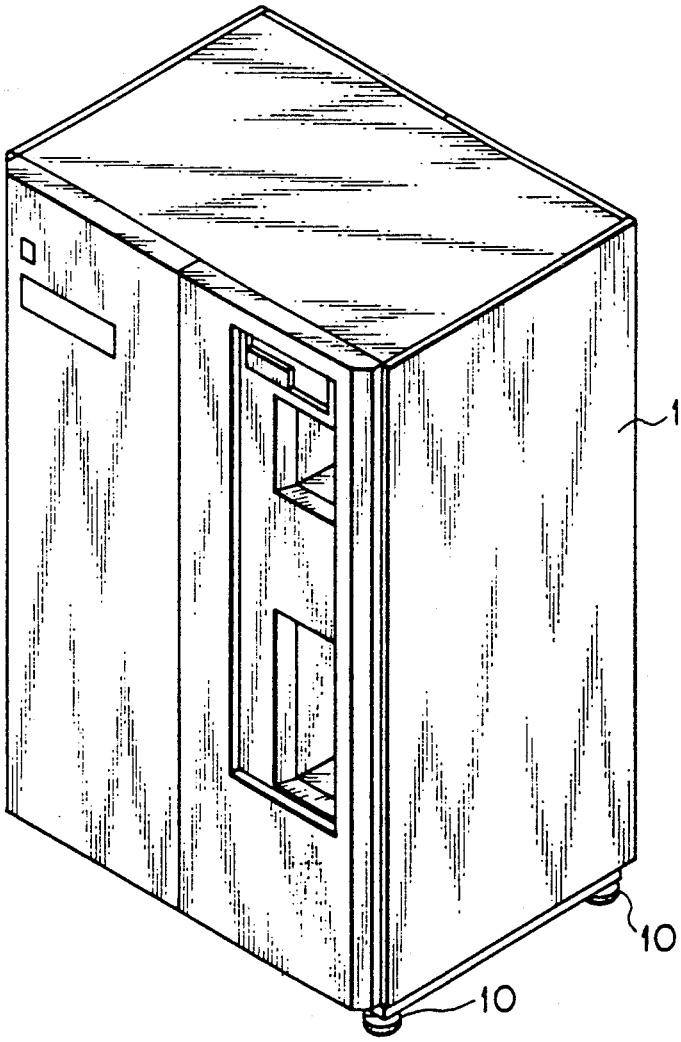
FIG. 4 is a perspective view of an example of an electronic apparatus.

FIG. 4 shows an example of an electronic apparatus such as a computer having an outer case 1 and electronic elements and printed wiring boards (not shown) installed in the outer case 1. The outer case 1 is placed on a floor (4, FIG. 1) by four leg support structures 10 at the corners of a bottom wall (1*a*, FIG. 1) of the outer case 1. The four leg support structures 10 have the same arrangement. One of them is described below in detail.

Figure 1:
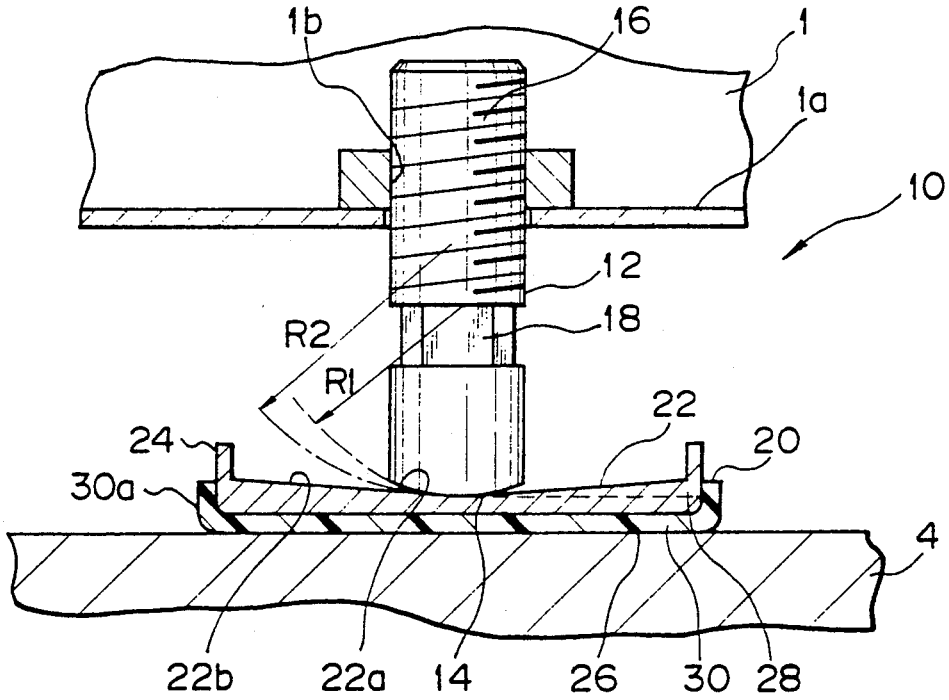
FIG. 1 is a cross-sectional view of a leg support structure of an electronic apparatus according to the first embodiment of the present invention.
Figure 2:
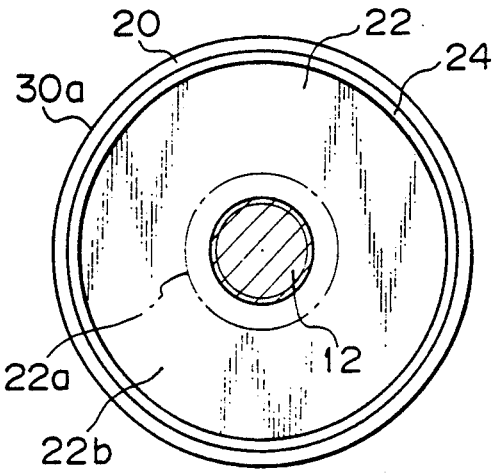
FIG. 2 is a top plan view of the leg support seat of FIG. 1.
Figure 3:
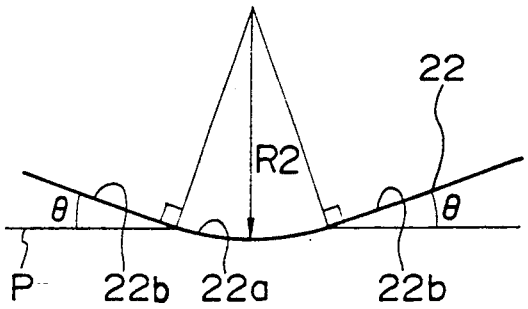
FIG. 3 is a diagrammatic vertical cross-sectional view of the upper surface of the leg support seat of FIG. 1.

FIGS. 1 to 3 show a leg support structure 10, which comprises a bolt-like leg 12 extending vertically downward from the outer case 1 and having a lower end surface 14 shaped in a convex spherical shape having a first radius of curvature R1. The leg 12 has a screw thread 16 formed at an upper portion thereof to be threadably engaged with a nut member 1*b* attached to the bottom wall 1*a* of the outer case 1. The leg 12 also has a polygonal prism portion 18 for engagement by a tool for rotating the leg 12 for adjustment of the height of the leg 12.

The leg support structure 10 also comprises a dish-shaped leg support seat 20 having an upper surface 22 for slidably receiving the lower end surface 14 of the leg 12, a peripheral flange 24 upwardly rising on the periphery of the upper surface 22, and a lower flat smooth surface 26 adapted to be put on the floor 4. As will be clear from FIG. 2, the leg support seat 20 is generally circular.

As can be seen, the leg support seat 20 preferably comprises a dish-shaped metal element 28, forming the upper surface 22 and the peripheral flange 24, and a liner 30 fixedly attached to the dish-shaped metal element 28 and forming the lower flat smooth surface 26. The metal element 28 is made from a hard metal such as SK steel, to sufficiently support the weight of the electronic apparatus 1 so as not to create a creep deformation at the upper surface 26. A lubricant such as oil or molybdenum disulfide is applied to the upper surface 22 to facilitate the leg 12 sliding over the upper surface 22.

The liner 30 is made from a plastic having a good slidable property such as polytetrafluoroethylene or nylon. These plastics have a self-lubricating property and a low coefficient of friction. The liner 30 is materially flat to stably support the electronic apparatus 1 and has an upwardly rising peripheral flange 30*a* to hold the metal element 28. The lower edge of the peripheral flange 30*a* is rounded so that the leg support seat 20 can ride over an obstacle or a small step in the floor 4. The liner 30 is added to the metal element 28 to form the lower flat smooth surface 26 in the illustrated embodiment, but it is of course possible to construct the leg support seat 20 as a one-piece structure. In this case, the bottom of the leg support seat 20 can be mechanically polished to form the lower flat smooth surface 26. A coefficient of friction between the leg support seat 20 and the floor 4 may be larger than a coefficient of friction between the leg 12 and the leg support seat 20. If the leg support seat 20 does not smoothly slide on the floor 4, it is possible to appropriately apply grease or molybdenum disulfide on the floor 4.

As shown in FIGS. 1 to 3, the upper surface 22 includes a central surface portion 22*a*, shaped in a concave spherical shape having a second radius of curvature R2, and a cone-shaped slope portion 22*b*, arranged around and tangential to the central surface portion 22*a*. The first radius of curvature R1 of the lower end surface 14 of the leg 12 is typically 30 mm and smaller than the second radius of curvature R2 of the central surface portion 22*a* of the upper surface 22 which is typically 40 mm. Accordingly, the leg 12 makes substantially point contact with the leg support seat 20 so that a frictional resistance therebetween is constant over the leg support seat 20 and the leg 12 slides smoothly along the leg support seat 20.

In the case of an earthquake, the floor 4 is subjected to vibration, and the leg support seat 20 follows. The moving leg support seat 20 slides relative to the leg 12 because of a low coefficient of friction between the leg 12 and the upper surface 22, so that the electronic apparatus 1 substantially remains at the initial position due to inertia thereof, that is, slides relative to the leg support seat 20 and the floor 4 and thus is less affected by the vibration.

By the provision of the central surface portion 22*a* of a concave spherical shape and the cone-shaped slope portion 22*b* in the upper surface 22 of the leg support seat 20, the leg 12 supporting the weight of the electronic apparatus 1 causes the leg support seat 20 to return to its original position at the end of the earthquake. For example, the amplitude of vibration of the earthquake may become gradually smaller at the end of the earthquake and may include more or less a vertical component which may cause the leg 12 to jump a small amount to allow the leg support seat 20 to instantaneously move horizontally while the leg 12 moves to a lower central position of the upper surface 22. Thus the leg 12 is normally placed at the center of the leg support seat 20.

When the amplitude of movement of the earthquake is relatively large, the leg support seat 20 first slides relative to the leg 12, as described above, until the leg 12 abuts against the peripheral flange 24 of the leg support seat 20, and then the leg support seat 20 with the leg 12 slides relative to the floor 4 so that the electronic apparatus is prevented from falling over, which might occur when the horizontally moving electronic apparatus is suddenly stopped at the leg 12 thereof.

Referring to FIG. 3, the central surface portion 22*a* and the cone-shaped slope portion 22*b* of the upper surface 22 are arranged by selecting the second radius of curvature R2 of the central surface portion 22*a* and the angle $\theta$ of the cone-shaped slope portion 22*b* formed with a plane P which is substantially parallel to the lower flat smooth surface 26 of the leg support seat 20. To select the angle $\theta$, it has been found to be preferable that the cone-shaped slope portion 22*b* be arranged at an angle $\theta$ of approximately one degree from a plane P parallel to the lower flat smooth surface 26 of the leg support seat 20. This is explained with reference to FIGS. 5 and 6, which are results of the tests searching how the acceleration and the displacement of the outer case 1 change with the change of the angle $\theta$ when a seismic wave of approximately 400 GAL is applied.

Figure 5:
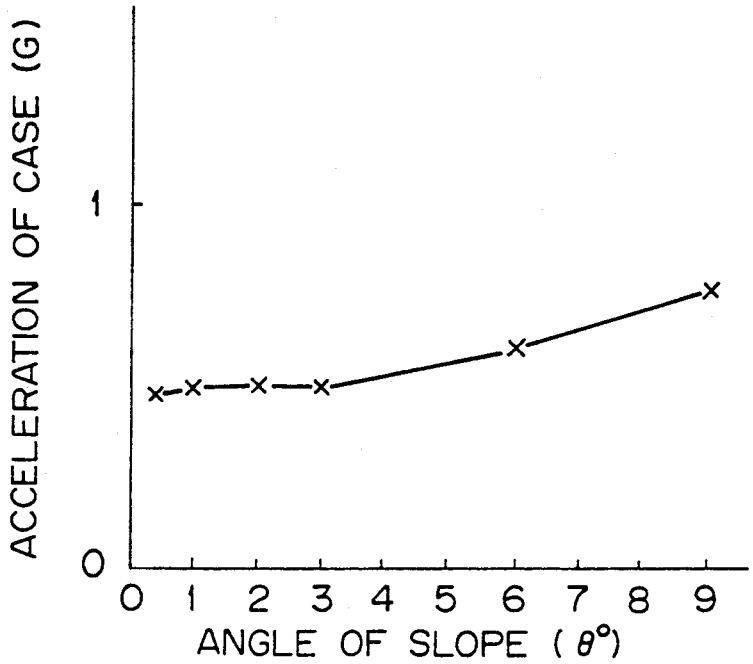
FIG. 5 is a graph illustrating the acceleration of the outer case versus the angle of slope of the upper surface of the leg support seat.
Figure 6:
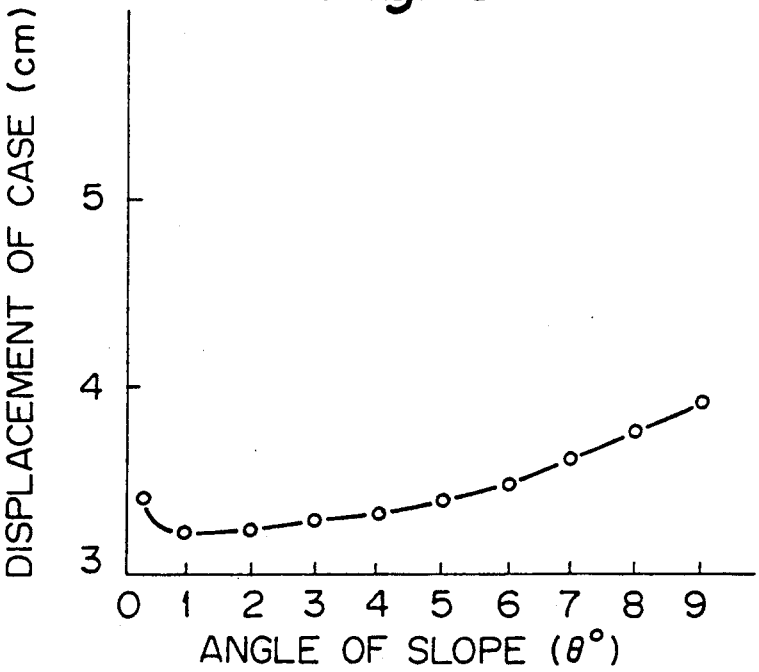
FIG. 6 is a graph illustrating the displacement of the outer case versus the angle of slope of the upper surface of the leg support seat.

FIG. 5 shows the acceleration of the outer case 1 versus the angle $\theta$, and FIG. 6 shows the displacement of the outer case 1 versus the angle $\theta$. From these results, it has been found that the acceleration of the outer case 1 is satisfactory if the angle $\theta$ is within the range of zero to three degrees, and the displacement of the outer case 1 is satisfactory to establish an excellent earthquake-proof effect if the angle $\theta$ is approximately one degree. Note, if the angle $\theta$ is too large, the displacement of the outer case 1 becomes large and the earthquake-proof effect is small, and if the angle $\theta$ is too small, the displacement of the outer case 1 becomes also large and the earthquake-proof effect is also small.

Figure 7:
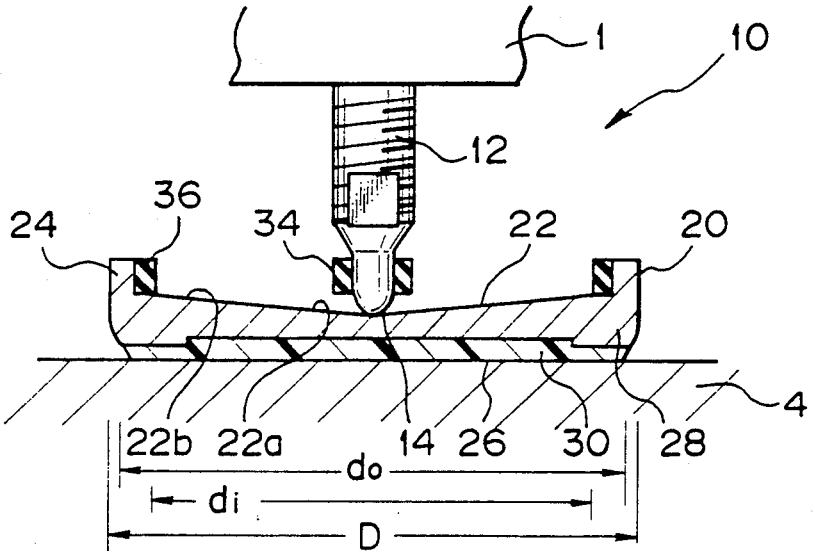
FIG. 7 is a cross-sectional view of a leg support structure of an electronic apparatus according to a second embodiment of the present invention.

FIG. 7 shows the second embodiment of the present invention. The leg support structure 10 of this embodiment comprises a bolt-like leg 12 having a lower end surface 14 of a convex spherical shape and a dish-shaped leg support seat 20 having an upper surface 22, a peripheral flange 24 upwardly rising on the periphery of the upper surface 22, and a lower flat smooth surface 26. Also, the leg support seat 20 comprises a dish-shaped metal element 28 and a liner 30 fixedly attached to the dish-shaped metal element 28, and the upper surface 22 includes a central surface portion 22*a* shaped in a concave spherical shape having a second radius of curvature R2, and a cone-shaped slope portion 22*b*.

In FIG. 7, an elastic element 34 made of rubber is attached to the leg 12, and an elastic element 36 made of rubber is attached to the peripheral flange 24, to absorb the impact of the leg 12 to the peripheral flange 24 when an earthquake occurs. It is possible to provide an elastic element only on one of the leg 12 and the peripheral flange 24 (see FIG. 8).

In FIG. 7, the metal element 24 of the leg support seat 20 has an outer peripheral surface generally flush with an outer peripheral surface of the peripheral flange 24 and a first dimension D (outer diameter when the leg support seat 20 is circular) measured along a predetermined line across the outer peripheral surface between two intersections of the predetermined line and the outer peripheral surface, and a second dimension $d_i$ (inner diameter) of an inner peripheral surface in the peripheral flange 24 measured in the same manner. The liner 30 does not radially protrude from the metal element 28 and has a third dimension $d_o$ (outer diameter of the lower flat smooth surface 26). Preferably, the third dimension $d_o$ is smaller than the first dimension D and greater than the second dimension $d_i$.

With this feature, the position of the leg 12 when it abuts against the peripheral flange 24 is always within the liner 30 while the preferable design is such that the liner 30 is not exposed from the metal element 28, and the portion of the liner 30 on the outside of the leg 12 bears the load of the electronic apparatus which may act on the peripheral flange 24 so as to generate a moment to tip over the electronic apparatus, so that the electronic apparatus is prevented from falling over.

Figure 8:
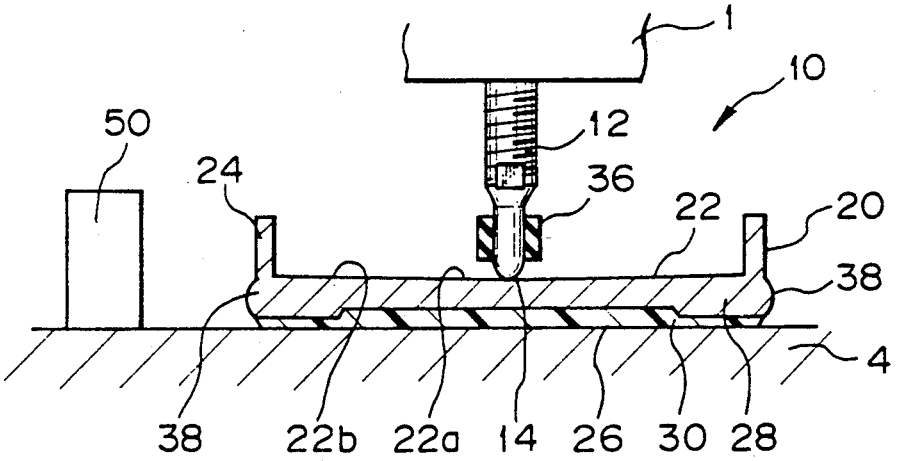
FIG. 8 is a cross-sectional view of a leg support structure of an electronic apparatus according to a third embodiment of the present invention.

FIG. 8 shows the third embodiment of the present invention. This embodiment includes similar elements to those of the previous embodiment and a repeated explanation of those elements is omitted.

In FIG. 8, the leg support seat 20 comprises a dish-shaped metal element 28 and a liner 30 fixedly attached to the bottom surface of the dish-shaped metal element 28. The dish-shaped metal element 28 has an outer peripheral lobe 38 arranged adjacent the bottom surface thereof and protruding from the peripheral flange 24 when viewed from above, and thus the outer peripheral surface about the outer peripheral lobe 38 has a first dimension (outer diameter) measured in the same manner as the first dimension D in FIG. 7. The second and the third dimensions are also measured in the same manner as the second and the third dimensions $d_o$ and $d_i$ in FIG. 7. The third dimension is smaller than the first dimension and greater than the second dimension, as described above.

The outer peripheral lobe 38 provides further advantages. It is possible to design the leg support seat 20 such that the liner 30 is hidden under the outer peripheral lobe 38 and so the liner 30 can have larger outer size to prevent the electronic apparatus from falling over.

Figure 9:
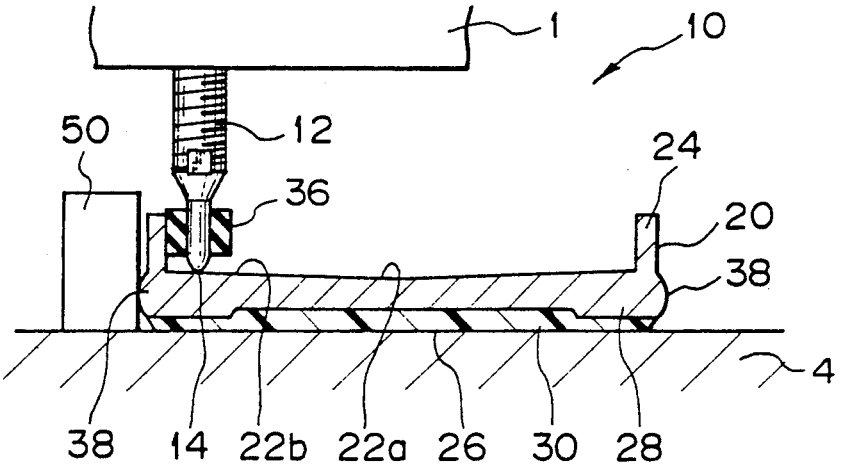
FIG. 9 is a view of the leg support structure of FIG. 8 when the displacement of the leg support seat is large.

As shown in FIGS. 8 and 9, if a relatively large obstacle 50 exists, the outer peripheral lobe 38 may strike the obstacle 50 in an earthquake. This is advantageous in comparison to a case in which the liner 30 itself strikes the obstacle 50 and the liner 30 peels off from the metal element 28.

Figure 10:
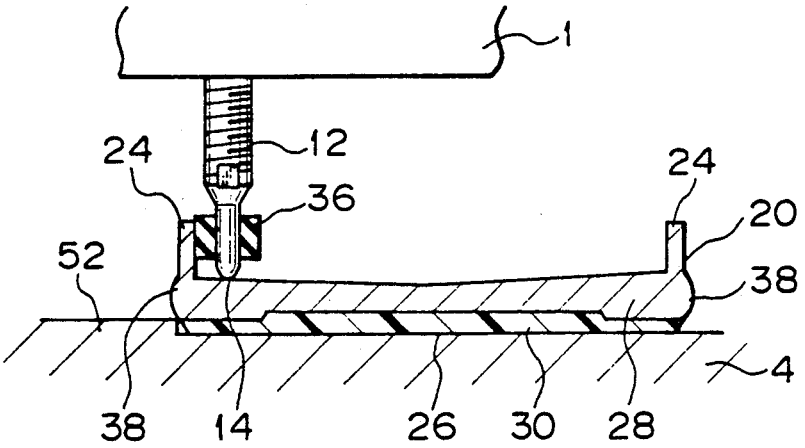
FIG. 10 is a view similar to FIG. 8 but showing a floor including a small step.

As shown in FIG. 10, if a relatively small obstacle 52, such as a small step of the floor 4 (interface between flooring panels), exists, the liner 30 and the outer peripheral lobe 38 are tapered in a continuous pattern or have continuously rounded edges and thus can ride over the obstacle 52 upon an earthquake. This advantage is due to the fact that it is possible to obtain a large radius of curvature in the continuously rounded edges of the liner 30 and the outer peripheral lobe 38 (the curvature of the liner 30 in FIG. 1 may be small if the thickness of the liner is identical).

Figure 11:
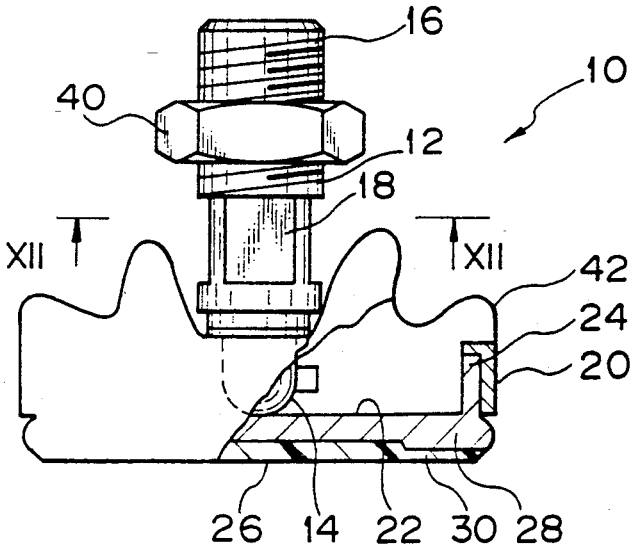
FIG. 11 is a view of a fourth embodiment of the present invention.
Figure 12:
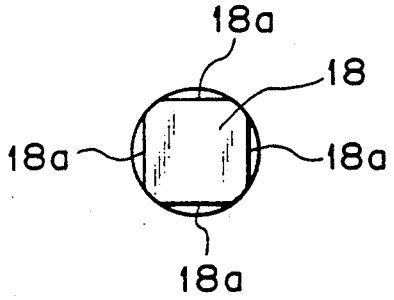
FIG. 12 is a cross-sectional view of the leg of FIG. 11 taken along the line XII—XII of FIG. 11.

FIGS. 11 and 12 show the fourth embodiment of the present invention. The leg support structure 10 comprises a bolt-like leg 12 and a dish-shaped leg support seat 20, similar to the previous embodiments. The leg 12 has a screw thread 16 formed at an upper portion thereof to be threadably engaged with the outer case 1 and a polygonal prism portion 18 for engagement by a tool for rotating the leg 12 for adjustment of the height of the leg 12. The polygonal prism portion 18 is shown in FIG. 12 and includes four flat surfaces 18*a*. A lock nut 40 is threaded on the screw thread 16 to engage the bottom of the outer case 1. In addition, a bellows type cover 42 is attached to the peripheral flange 24 so that the leg 12 extends through the center of the cover 42 to prevent foreign matter entering the upper sliding surface 22. The cover 42 can deform following the relative movement of the leg 12 and the leg support seat 20.

Figure 14:
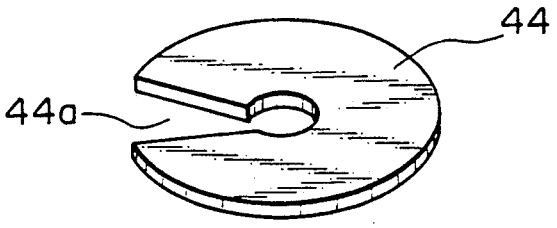
FIG. 14 is a view of the cover of FIG. 13.
Figure 15:
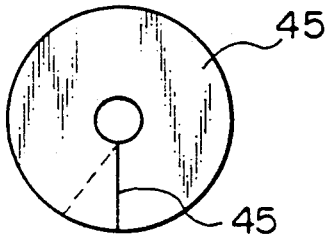
FIG. 15 is a view of a modified cover.
Figure 16:
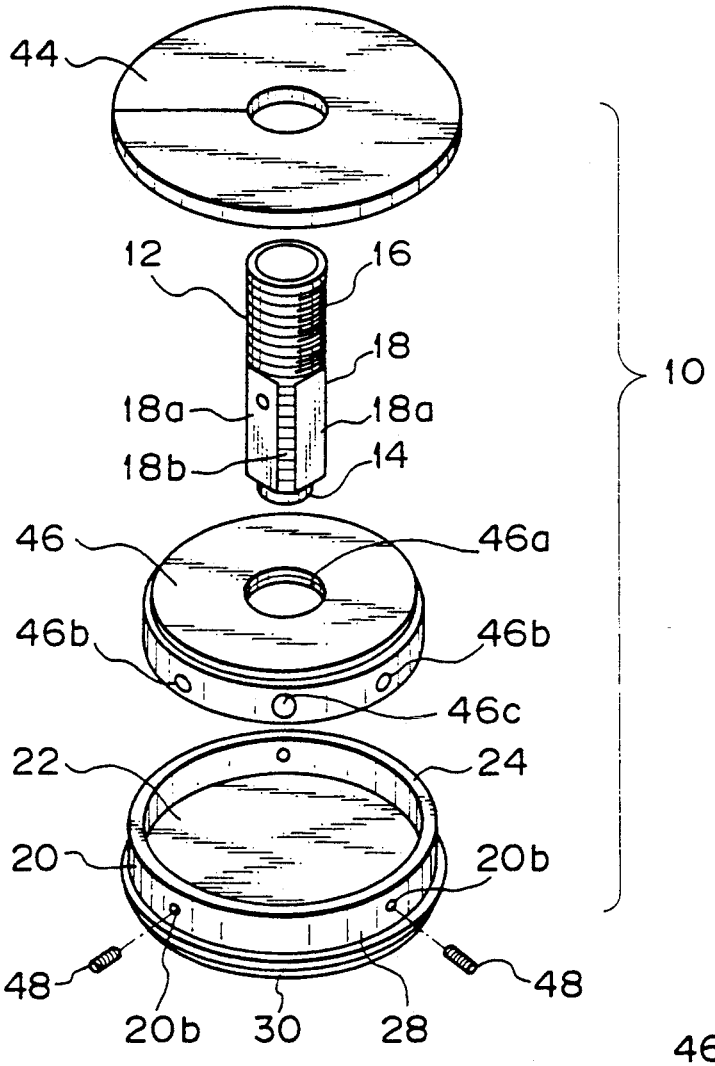
FIG. 16 is an exploded perspective view of the leg support structure of FIG. 13.

FIGS. 13 to 17 show the fifth embodiment of the present invention. The leg support structure 10 comprises a bolt-like leg 12 and a dish-shaped leg support seat 20, similar to the previous embodiments. The leg 12 has a screw thread 16 formed at an upper portion thereof and a polygonal prism portion 18 including four flat surfaces 18*a*. As shown in FIG. 16, the polygonal prism portion 18 includes axially extending screw thread portions 18*b* between the adjacent flat surfaces 18*a* and contiguous to the upper screw thread 16.

A flat cover 44 is put on the peripheral flange 24 with the leg 12 extending through the cover 44. The cover 44 is made from rubber or the like and has a radial slit 44*a* at which the cover 44 can be spread, as shown in FIG. 14. Accordingly, the cover 44 can be inserted over the leg 12 after the leg support structure 10 is set to the outer case 1 of the electronic apparatus. The cover 44 moves with the leg 12 and may shift relative to the leg support seat 20 upon an earthquake. But the cover 44 can usually cover the upper sliding surface of the leg support seat 20.

Figure 13:
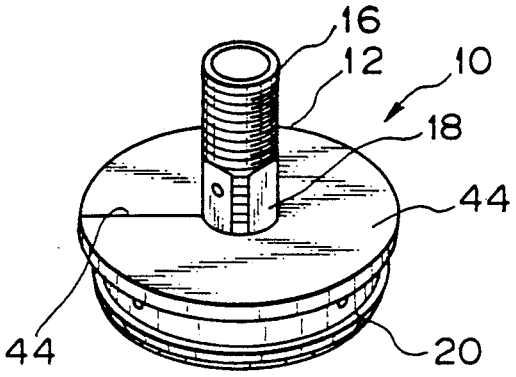
FIG. 13 is a view of a fifth embodiment of the present invention.

FIG. 15 shows an alternative flat cover 45 having a radial slit 45*a* which is cut obliquely to the plane of the cover 45 while the radial slit 44*a* of the flat cover 44 in FIGS. 13 and 14 is cut perpendicularly to the plane of the cover 44.

As shown in FIG. 16, a plate-like or ring-like adapter 46 is further provided. The adapter 46 has a central hole 46*a* with an internal thread which threadably engages with the upper screw thread 16 and the thread portions 18*b* of the polygonal prism portion 18 and is thus secured to the leg 12. The adapter 46 has a plurality of threaded holes 46*b* at the outer periphery thereof and the peripheral flange 24 of the leg support seat 20 has a plurality of correspondingly threaded holes 20*b*, so that the adapter 46 is inserted in the peripheral flange 24 of the leg support seat 20 and secured to the leg support seat 20 by screws 48 which engage in the threaded holes 46*b* and 20*b*. Accordingly, the leg support seat 20 is secured to the leg 12 via the adapter 46 for the transportation of the electronic apparatus with the leg support structure 10 secured thereat, the adapter 46 serving to prevent the leg support seat 20 from being lost. In addition, the adapter 46 has holes 46*c* at the outer periphery thereof for engagement with a tool such as a screwdriver by which the adapter 46 is rotated. FIG. 13 shows the leg support structure 10 in the transportation position.

Figure 17:
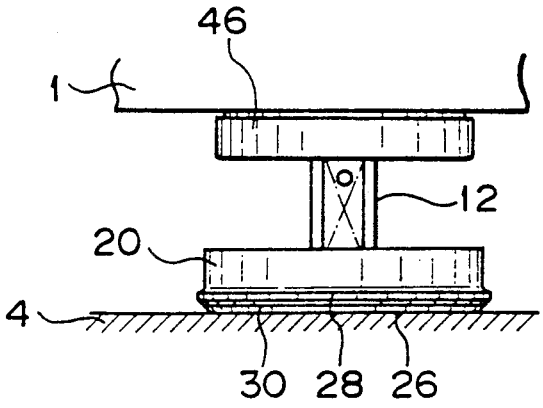
FIG. 17 is a view of the leg support structure of FIGS. 13 and 16 when fully assembled.

In the case where the electronic apparatus is to be placed in position, the cover 44 is removed from the leg 12 by laterally pulling the cover 44, and the screws 48 are released to separate the leg support seat 20 from the leg 12. Then the adapter 44 is rotated to a slightly upper position along the leg 12, and the height of the leg 12 is adjusted on the leg support seat 20 relative to the electronic apparatus. Then the adapter 44 is further rotated to contact the bottom of the outer case of the electronic apparatus and act as a lock nut, as shown in FIG. 17. Finally, it is possible to mount the cover 44 on the peripheral flange 24 of the leg support seat 20 by laterally urging the cover 44 to the leg 12.

FIGS. 18A to 23 are further modified embodiments of the present invention. These embodiments include at least one magnetic element 49 attached to at least one of the leg 12 and the leg support seat 20 to apply a braking action to the leg 12 relative to the leg support seat 20, to reduce the excessively sensitive movement of the leg 12 relative to the leg support seat 20.

Figure 18A:
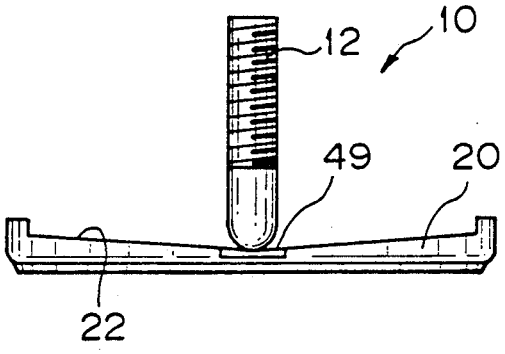
FIG. 18A is a side cross-sectional view of a sixth embodiment of the present invention.
Figure 18B:
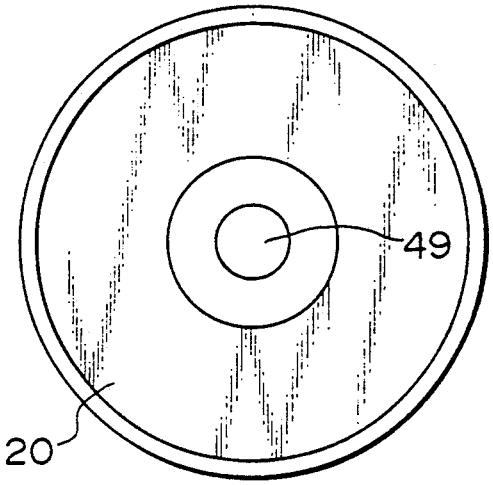
FIG. 18B is a top plan view of seat structure of FIG. 18A.
Figure 19A:
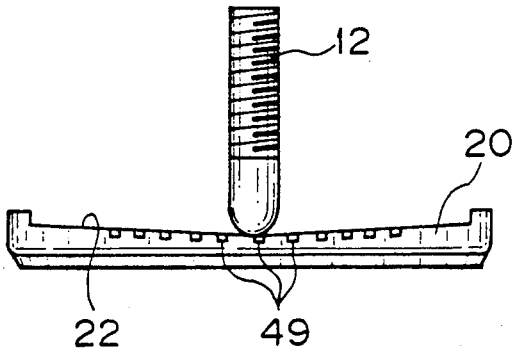
FIG. 19A is a side cross-sectional view of a modified embodiment.
Figure 19B:
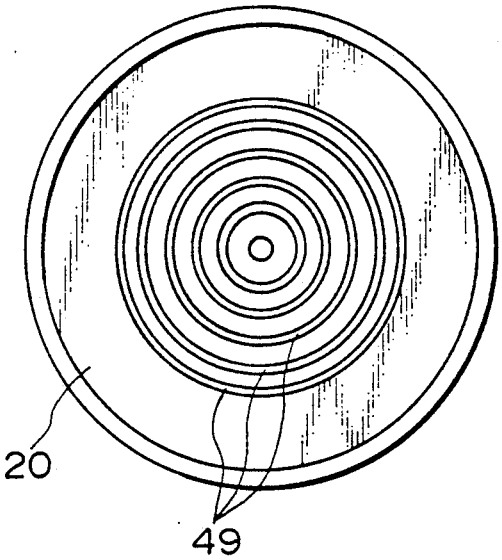
FIG. 19B is a plane view of the structure of FIG. 19A.
Figure 20:
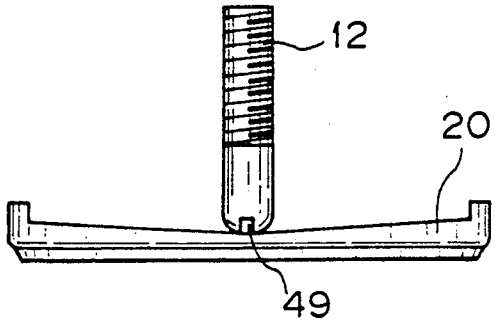
FIG. 20 is a side cross-sectional view of a further modified embodiment.

In FIGS. 18A and 18B, the permanent magnet 49 is arranged at the center of the leg support seat 20. In FIGS. 19A and 19B, the permanent magnets 49 are arranged in a concentric pattern at the leg support seat 20. In FIG. 20, the permanent magnet 49 is arranged at the lower end of the leg 12.

Figure 21:
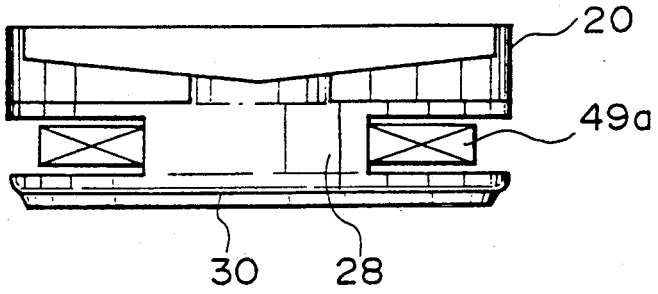
FIG. 21 is a side cross-sectional view of a further modified embodiment.
Figure 22:
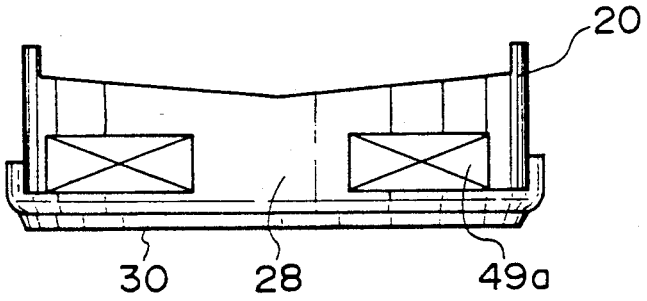
FIG. 22 is a side cross-sectional view of a further modified embodiment.
Figure 23:
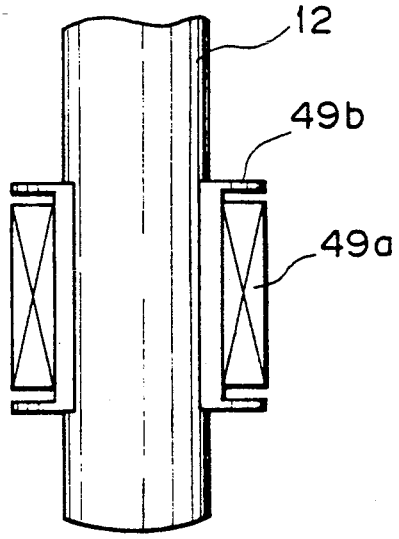
FIG. 23 is a side cross-sectional view of a further modified embodiment.

In FIG. 21, an electromagnet is attached to the leg support seat 20 in which a solenoid coil 49*a* is wound around a neck portion of the metal element 28 of the leg support seat 20, the neck portion serving as a core member. In FIG. 22, an electromagnet is attached to the leg support seat 20 in which a solenoid coil 49*a* is embedded in the metal element 28 and wound around a neck portion thereof. In FIG. 23, an electromagnet is attached to the leg 12 in which a solenoid coil 49*a* is wound around the leg 12 via a plastic sleeve 49*b*.

We claim:

1. A leg support structure of an electronic apparatus having an outer case, the leg support structure comprising:

a leg extending vertically downward from the outer case and having a lower end surface of a convex spherical shape and a dish-shaped leg support seat having an upper surface for slidably receiving the lower end surface of the leg, a periphery, a peripheral flange upwardly rising on the periphery of the upper surface, and a lower flat smooth surface adapted to be put on a supporting surface, the upper surface of the leg support seat including a central surface portion of a concave spherical shape and an outer peripheral surface portion contiguous to the central surface portion whereby the lower end surface of the leg can slide on the central surface portion and the outer peripheral surface portion upon an earthquake, and the leg may abut against the peripheral flange and move with the leg support if the shock of the earthquake is large.

2. A leg support structure according to claim 1, wherein the lower end surface of the leg has a first radius of curvature, and the central surface portion of the upper surface of the leg support seat has a second radius of curvature, the first radius of curvature being smaller than the second radius of curvature.

3. A leg support structure according to claim 1, wherein the outer peripheral surface portion is a cone-shaped slope portion arranged around and tangential to the central surface portion.

4. A leg support structure according to claim 3, wherein the cone-shaped slope portion is arranged at an angle of approximately one degree with a plane parallel to the lower flat smooth surface of the leg support seat.

5. A leg support structure according to claim 1, wherein the leg is arranged such that the leg slidably engages with the upper surface of the leg support seat and may abut against the peripheral flange, and wherein at least one elastic element is attached to at least one of the leg and an inner surface of the peripheral flange to absorb any impact of the leg against the peripheral flange.

6. A leg support structure according to claim 1, wherein the leg support seat is circular.

7. A leg support structure according to claim 1, wherein the leg support seat comprises a dish-shaped metal element which forms the upper surface and the peripheral flange, and a liner fixedly attached to the dish-shaped metal element which forms the lower flat smooth surface, the liner being slidable on the supporting surface.

8. A leg support structure according to claim 7, wherein the dish-shaped metal element has an outer peripheral surface generally flush with an outer peripheral surface of the peripheral flange, a first dimension measured along a predetermined line across the outer peripheral surface between two intersections of the predetermined line and the outer peripheral surface, an inner peripheral surface in the peripheral flange, and a second dimension measured along the predetermined line across the inner peripheral surface between two intersections of the predetermined line and the outer peripheral surface, and the liner has an outer peripheral surface and a third dimension measured along the predetermined line across the outer peripheral surface thereof between two intersections of the predetermined line and the outer peripheral surface, the third dimension being smaller than the first dimension and greater than the second dimension.

9. A leg support structure according to claim 7, wherein the dish-shaped metal element has a bottom surface, an outer peripheral lobe arranged adjacent the bottom surface and protruding from the peripheral flange, an outer peripheral surface about the outer peripheral lobe, a first dimension measured along a predetermined line across the outer peripheral surface between two intersections of the predetermined line and the outer peripheral surface, an inner peripheral surface in the peripheral flange, and a second dimension measured along the predetermined line across the inner peripheral surface between two intersections of the predetermined line and the outer peripheral surface, and the liner has an outer peripheral surface and a third dimension measured along the predetermined line across the outer peripheral surface thereof between two intersections of the predetermined line and the outer peripheral surface, the third dimension being smaller than the first dimension and greater than the second dimension.

10. A leg support structure according to claim 9, wherein the outer peripheral lobe of the dish-shaped metal element and the liner are tapered in a continuous pattern.

11. A leg support structure according to claim 10, wherein the outer peripheral lobe of the dish-shaped metal element and the liner are rounded in a continuous pattern.

12. A leg supports structure according to claim 1, wherein a bellows type cover is attached to the peripheral flange with the leg extending through the cover.

13. A leg support structure according to claim 1, wherein a flat cover having a radial slit is put on the peripheral flange with the leg extending through the cover.

14. A leg support structure of an electronic apparatus having an outer case, the leg support structure comprising:

a leg extending vertically downward from the outer case and having a lower end surface of a convex spherical shape;

a dish-shaped leg support seat having an upper surface for slidably receiving the lower end surface of the leg and including a central surface portion of a concave spherical shape and a periphery, a peripheral flange upwardly rising on the periphery of the upper surface, and a lower flat smooth surface adapted to be put on a supporting surface;

a flat cover having a radial slit on the peripheral flange with the leg extending through the cover; and a plate-like adapter secured to the leg, the adapter having means for securing the leg support seat therewith.

15. A leg support structure according to claim 14, wherein the adapter is threadably secured to the leg and movable between a seat securing position and a further upper position.

16. A leg support structure of an electronic apparatus having an outer case, the leg support structure comprising:

a leg extending vertically downward from the outer case and having a lower end surface of a convex spherical shape;

a dish-shaped leg support seat having an upper surface for slidably receiving the lower end surface of the leg and including a central surface portion of a concave spherical shape and a periphery, a peripheral flange upwardly rising on the periphery of the upper surface, and a lower flat smooth surface adapted to be put on a supporting surface; and at least one magnetic element attached to at least one of the leg and the leg support seat to apply a braking action to the leg relative to the leg support seat.

* * * * *

UNITED STATES PATENT AND TRADEMARK OFFICE

CERTIFICATE OF CORRECTION

PATENT NO. : 5,310,156

DATED : May 10, 1994

INVENTOR(S) : Tadanobu MATSUMURA et al.

It is certified that error appears in the above-identified patent and that said Letters Patent is hereby corrected as shown below:

- In the Drawings - Sheet 7 of 10 - Figure 13, change "44" (on left side of the figure) to --44a--.

Column 3, line 57, after "of" (first occurrence) insert --the--;

line 61, change "plane" to --top plan--, and after "the" insert --seat--.

* - Column 7, line 4, after "have" insert --a--.

Column 10, claim 15, line 47, change "14" to --17--.

Signed and Sealed this

Twentieth Day of September, 1994

*Attest:*

Bruce Lehman

BRUCE LEHMAN

*Attesting Officer*

*Commissioner of Patents and Trademarks*